US005218345A

United States Patent [19]

Muller et al.

[11] Patent Number: 5,218,345

[45] Date of Patent: Jun. 8, 1993

[54] APPARATUS FOR WIDE-AREA FIRE DETECTION

[75] Inventors: Kurt A. Muller, Stäfa; Christoph Enderli, Jona; Peter Ryser, Stäfa, all of Switzerland

[73] Assignee: Cerberus AG, Mannedorf, Switzerland

[21] Appl. No.: 844,799

[22] Filed: Mar. 2, 1992

[30] Foreign Application Priority Data

Mar. 1, 1991 [CH] Switzerland ..... 643/91

[51] Int. Cl.[5] ..... G08B 17/12

[52] U.S. Cl. ..... 340/578; 250/338.1; 250/342; 250/395; 250/554

[58] Field of Search ..... 340/578, 577; 250/338.1, 338.2, 338.3, 338.4, 342, 395, 554

[56] References Cited

U.S. PATENT DOCUMENTS

| | | | |
|---|---|---|---|
| 1,959,702 | 5/1934 | Barker | 250/342 |
| 3,665,440 | 5/1972 | McMenamin | 250/338.1 |
| 4,249,207 | 2/1981 | Harman et al. | 358/108 |
| 4,258,259 | 3/1981 | Obara et al. | 250/338.3 |
| 4,745,284 | 5/1988 | Masuda et al. | 250/338.3 |
| 4,906,976 | 3/1990 | Guscott | 250/338.3 |
| 4,990,783 | 2/1991 | Muller et al. | 250/342 |
| 5,049,756 | 9/1991 | Brown de Colstoun et al. | 250/554 |

FOREIGN PATENT DOCUMENTS

| | | |
|---|---|---|
| 0298182 | 1/1989 | European Pat. Off. . |
| 3710265 | 10/1988 | Fed. Rep. of Germany . |
| 59-136629 | 8/1984 | Japan . |

*Primary Examiner*—Glen R. Swann, III

*Attorney, Agent, or Firm*—Brumbaugh, Graves, Donohue & Raymond

[57] ABSTRACT

In fire detector apparatus for monitoring an extended area from an elevated location, and especially for detecting forest fires, a scanning assembly (1) has azimuthal freedom of movement. A row of adjoining infrared detector element pairs (S, S') is disposed on a common support (7) in the focal plane of a reflector (6). Detector extent or area increases from the optical axis upward, and the detectors are connected with decreasingly sensitive circuitry. As a result, detection areas having different elevations have nearly equal distance range, and detection sensitivity is essentially independent of distance so that a remote forest fire is detected with the same degree of certainty as one close by. For the elimination of false alarms due to diffuse thermal radiation, detector elements are arranged in pairs, side-by-side on the same support (7), and connected in differential circuitry. For the elimination of false alarms due to intense sunlight, light-sensitive solar cells are connected in parallel with the infrared detectors in an inhibition circuit.

14 Claims, 4 Drawing Sheets

APPARATUS FOR WIDE-AREA FIRE DETECTION

BACKGROUND OF THE INVENTION

This invention relates to wide-area fire detection and especially to the detection of forest fires.

Wide-area fire detector apparatus as known, e.g., from European Patent Document EP-A1-0298182, serves for the localization of infrared radiation emitted by objects at a temperature in a range of approximately 300° to 1500° C. in a surveillance area extending several kilometers. Such apparatus is particularly suited for the detection of forest fires from a central observation point in a large forested area. Included in such apparatus is a scanning device with azimuthal freedom of movement and with an optical focusing device, e.g., a reflector, for directing infrared radiation from forest fires in a number of detection areas onto a corresponding number of detector elements. Such detector elements are arranged closely spaced in a row perpendicular to the reflector axis. When the detector apparatus is rotated or panned azimuthally and approximately horizontally about an approximately vertical axis, a number of concentric detection areas result which have different elevation or inclination to the horizontal, and which are periodically scanned as the apparatus turns. If a detector apparatus is installed at an elevated location, e.g., on a mountaintop or on a tall mast, an area extending several kilometers can be monitored by a single detector apparatus for infrared radiation originating from forest fires. The site of a fire can be determined and reported by means of a suitable evaluation circuit.

It is a drawback of such known apparatus that the sensitivity of detection decreases with increasing distance, i.e., with decreasing elevation or inclination of a detection area from the horizontal. In other words, detection of a fire is more difficult at a distance than at close range. In accordance with German Patent Document DE-A1-3710265, this disadvantage is avoided when a detector apparatus moves not only azimuthally, but also by periodic variation of the angle of elevation. During such vertical panning movement, the focal length of the focusing device is automatically adjusted, as a function of the angle of elevation, to maintain approximately constant infrared detector resolution in the entire surveillance area. This requires complicated and failure-prone control means with additional movable components. As a result, long-term operation at a remote location is virtually impossible, as the apparatus requires frequent service.

A further disadvantage of such known forest-fire detectors lies in their susceptibility to parasitic infrared radiation from extraneous sources, especially to direct or reflected solar radiation. While the intensity peak of solar radiation lies in the range of visible light, solar intensity in the infrared range, i.e., in the range of thermal radiation from a forest fire, can be strong enough to erroneously trigger a fire alarm signal. Even diffuse light can have such strong infrared component triggering a false alarm.

SUMMARY OF THE INVENTION

The invention provides wide-area fire detector apparatus with reduced dependence of the detector sensitivity on the distance to a fire site, and with reduced likelihood of malfunction due to parasitic radiation having a radiation maximum in another spectral range. For the elimination of parasitic radiation, the infrared-sensitive detector elements are arranged pair-wise in differential circuits. And, alone or in combination with such pair-wise arrangement, additional, light-sensitive detector elements are included with corresponding infrared-sensitive detector elements in an inhibition circuit for eliminating solar radiation.

Preferably, the detector elements are formed and/or arranged such that detector sensitivity does not decrease significantly with decreasing angle of inclination from the horizontal, of the detection areas formed by the detector elements and the optical focusing apparatus.

Particularly advantageous are provisions for increased detector sensitivity, as a function of decreasing angle of elevation (and thus of increasing distance), including increased detector receiving areas or an increased number of equal-area detectors for detection at greater distances. Advantageous further, for achieving distance-independent sensitivity, is the provision of different degrees of amplification in the evaluation circuits for different detector elements, as a function of the angle of elevation of the corresponding detection regions.

Advantageously, several groups of detector elements are combined into an optical assembly on a common support in a row perpendicular to the optical axis of the assembly, with groups close to the optical axis (and serving for long-range detection) having a lesser vertical extent, a lesser receiving area, or a lesser number of detector elements as compared with groups at a greater distance from the optical axis (and serving for close-range detection).

Preferably included with the infrared-sensitive detector elements are light-sensitive detector elements in differential circuits for screening out solar radiation. Preferably, the former are sensitive to radiation in the spectral range of approximately 3–5 micrometers, and the latter to radiation in the spectral range of approximately 0.6–1 micrometer, i.e., in the visible and near infrared range. When such light-sensitive detector elements are connected to the infrared-sensitive detector elements in inhibition circuits, alarm signals are blocked when the light-sensitive detector elements receive optical radiation of at least a predetermined intensity. Thus, high-intensity optical radiation will not be reported as from a fire.

DETAILED DESCRIPTION OF PREFERRED EMBODIMENTS

Figure 1:
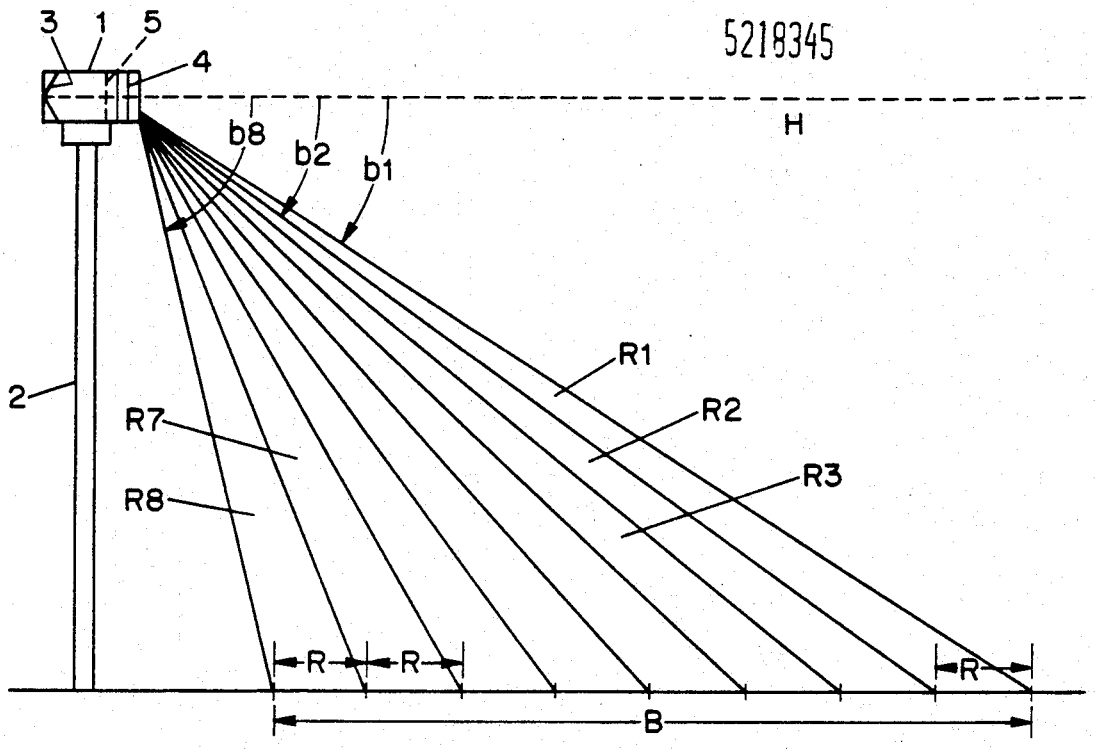
FIG. 1 is a schematic side view of fire detector apparatus in accordance with a preferred embodiment of the invention.

The apparatus of FIG. 1, for the detection of forest fires in an area B having an extent of several kilometers, comprises a scanning device 1 disposed at an elevated location of the surveillance area, e.g., on a mountaintop, on an observation tower 2, or on a mast. The scanning device 1 rotates or pans continuously and azimuthally about its vertical axis, periodically covering the entire surveillance area, receiving infrared radiation from the surveillance area by means of an optical assembly 3, and directing the radiation onto a detector assembly 4 which is connected to a suitable evaluation circuit for triggering an alarm signal when the detector assembly receives infrared radiation from the surveillance area characteristic of a forest fire.

Figure 2:
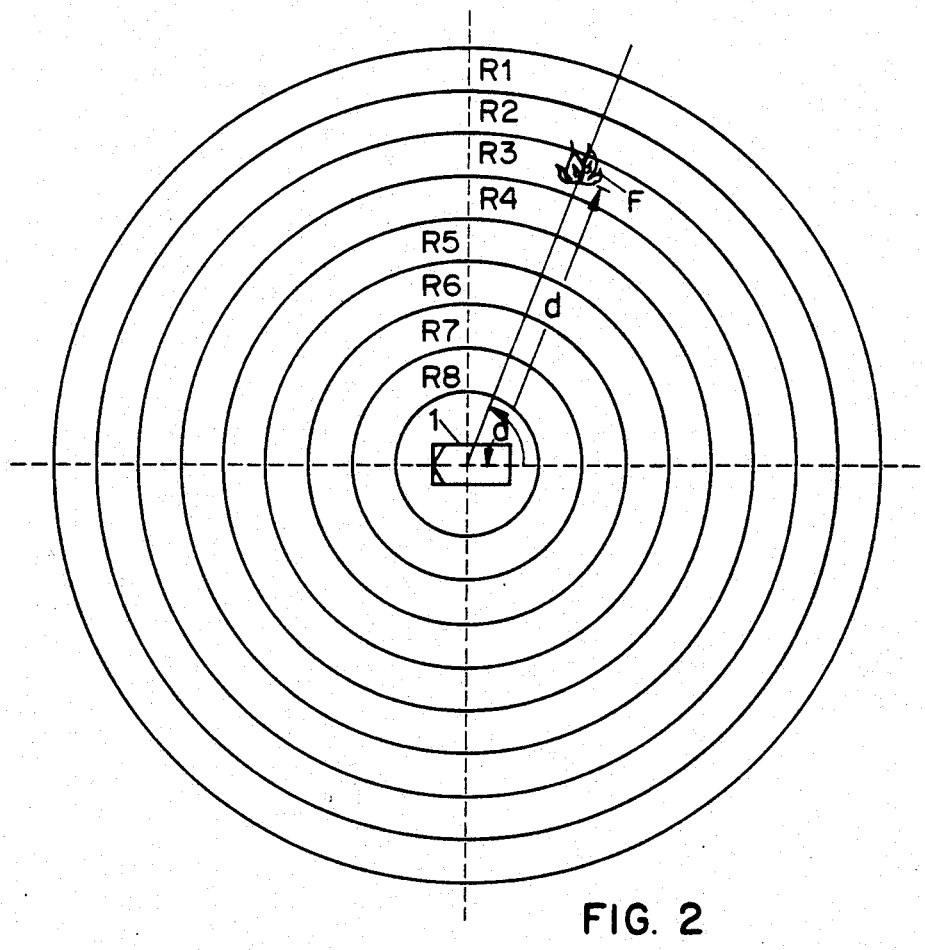
FIG. 2 is a schematic top view of the apparatus of FIG. 1 and of its area of surveillance.

As can be appreciated with reference to FIG. 2, the optical assembly 3 and detector assembly 4 are constructed and mutually disposed such that a number of separate, adjoining detection areas R1, R2, . . . , R8 are formed, concentric with respect to the location of the detector or scanning device, and with different elevation angles b1, b2, . . . , b8 with the horizontal H. Infrared radiation is separately received from and evaluated for these detection areas, so that, by means of the evaluation circuit, the azimuth a and distance d of a forest fire F can be determined and reported.

Figure 3:
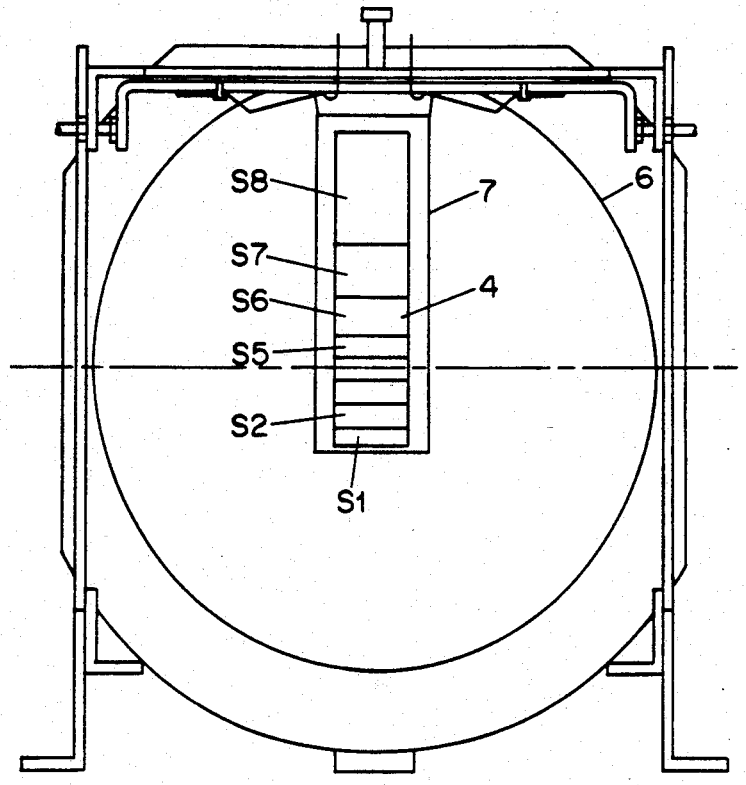
FIG. 3 is a schematic front view of a scanner assembly of a preferred fire detector apparatus.
Figure 4:
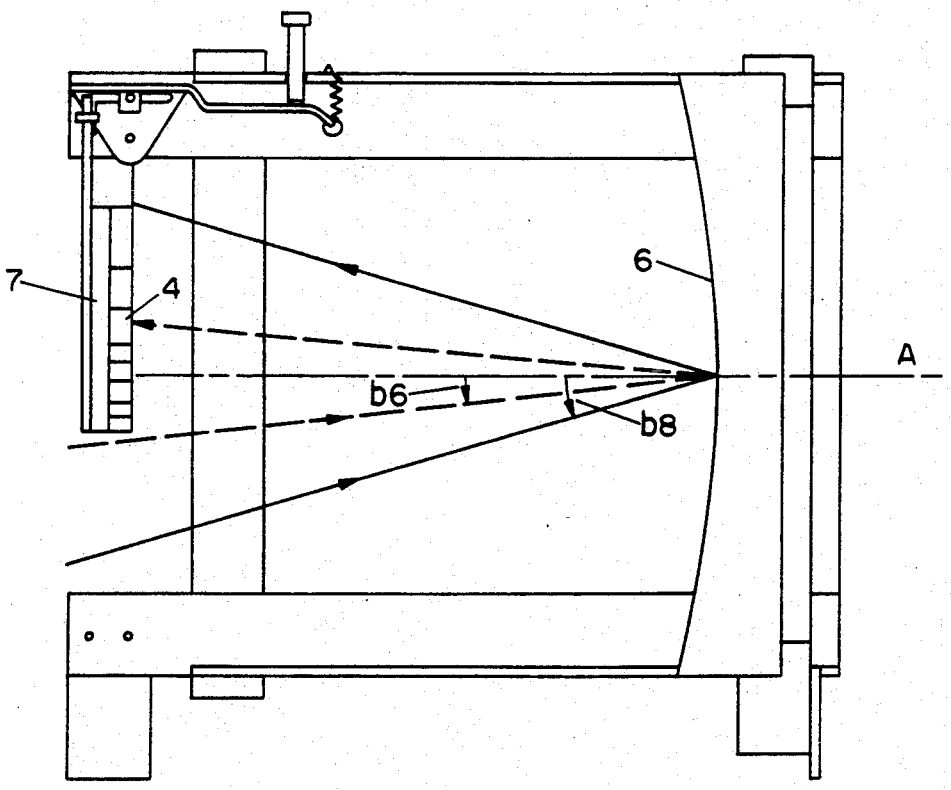
FIG. 4 is a cross section of the scanner apparatus of FIG. 3.

FIG. 3 and 4 show the construction of the scanning device 1 in further detail. Included, for focusing of infrared radiation arriving from the detection areas, is a spherical or parabolic reflector 6 and a detector support 7 for a number of detector elements S1, S2, . . . , S8 disposed at least approximately in the focal plane of the reflector 6. The axis A of the reflector 6 is horizontal or at a slight tilt with the horizontal, corresponding to the maximum detection distance, i.e., to the angle of elevation of the detection area R1 farthest away. The detector support is disposed asymmetrically relative to the optical axis A and extends upward for a distance, approximately from the axis A, such that only radiation from areas below the horizontal H are practically detected.

A number of detector elements S1, S2, . . . , S8 are provided radially on the detector support, forming separate radiation-sensitive zones, chips or "flakes" (of lithium tantalate, for example) whose output signals (to be evaluated separately) correspond to the radiation from the different detection areas (having different angles of elevation). The detector support 7 is located behind a window which is substantially transparent to thermal radiation from objects having a temperature of approximately 300° to 1500° C., so that, advantageously, the detector assembly responds only to radiation characteristic of a forest fire. Preferably, the window serves as an optical bandpass filter for passing 3- to 5-micrometer infrared radiation.

The above-mentioned spectral window has proven particularly advantageous because air is substantially transparent in its range, so that infrared detection is feasible over long distances. This is in contrast to the range from 5 to 8 micrometers where atmospheric absorption is considerable, with radiation from remote areas much attenuated and of limited utility for evaluation, and with severely limited detector range. Radiation at yet-greater wavelengths is likely to be parasitic radiation from objects having a temperature which is only slightly elevated. For example, such radiation may originate with automobile engines or from field or forest areas heated by intense sunlight.

Figure 5:
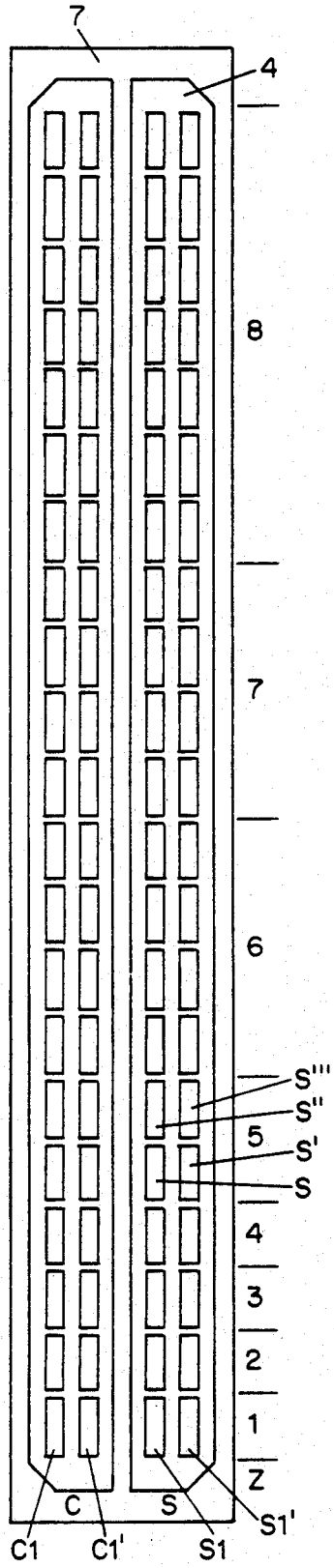
FIG. 5 is a front view of an assembly of detector elements in apparatus of FIG. 1 and 2.
Figure 6D:
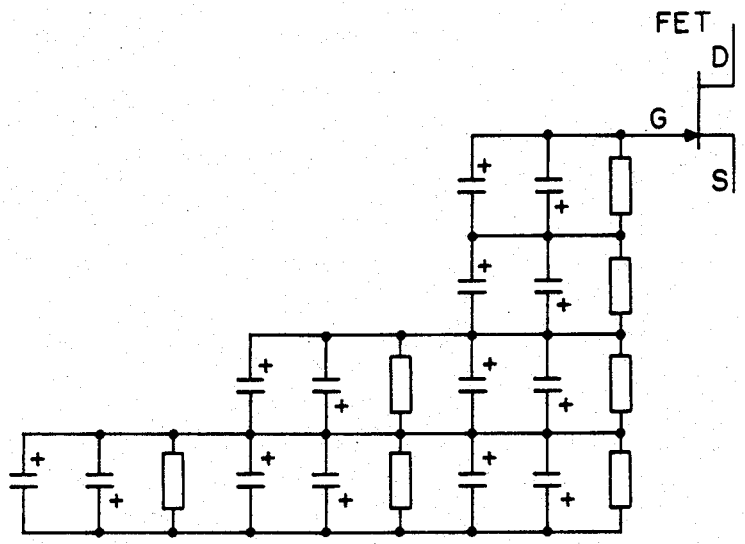
FIG. 6A through 6D are interconnection circuit diagrams for infrared detectors included in the assembly of FIG. 5.
Figure 6C:
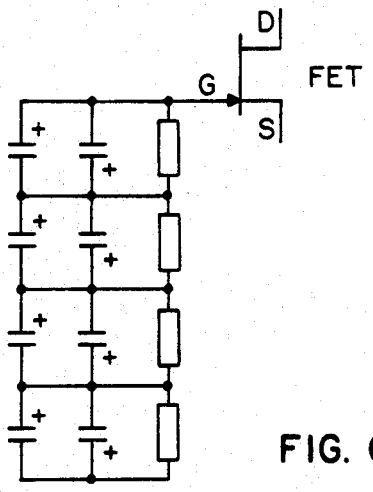
Figure 6B:
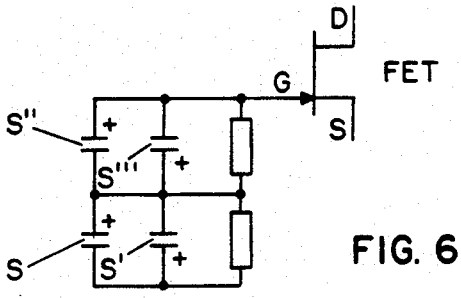
Figure 6A:
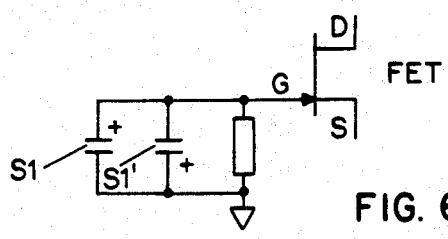

FIG. 5 shows the detector support on an enlarged scale and in further detail. The detector elements S are in the form of closely spaced flakes which are grouped pair-wise into zones whose length increases from bottom to top. The bottom-most group or zone Z1 serves for remote detection and includes just two flakes S1 and S1' which are differentially connected, in a dual circuit shown in FIG. 6A, to the input terminal FET of a signal evaluation circuit. The same type of circuitry is provided for each of the adjacent groups Z2, Z3, Z4. The group Z5, on the other hand, includes two pairs of flakes, namely the four detector elements S, S', S'' and S''' in a differential quad-circuit shown in FIG. 6B. The further groups Z6 and Z7 each include eight detector elements in a differential double-quad-circuit shown in FIG. 6C. The top-most group Z8, serving for close-range detection, has the greatest vertical extent and consists of fourteen flakes which are grouped into seven pairs which are connected in a differential circuit shown in FIG. 6D. These differential pair- or dual-circuits serve to eliminate environmental influences which affect the two sensor elements of a pair equally. This applies, e.g., to intense ambient light reaching a pyroelectric broad-band detector to a non-negligible degree with radiation in the passband range of 3 to 5 micrometers equally affecting the two paired detector elements. In contrast, radiation from a localized fire site is sensed at slightly different times during a panning sweep by these detector elements, so that the differential circuit produces a signal which includes a positive and a negative pulse (steady-state signal=zero).

Due to increased height of detector zones towards the upper end of the detector array Z1, Z2, . . . , Z8, each zone corresponds roughly to an equal distance range R. Furthermore, due to different parasitic capacitance in the different circuits for the detector elements of different zones (i.e., in the dual-, quad-, double-quad circuits, etc.), detection sensitivity is largely independent of distance, or may even increase with increasing distance, thereby providing compensation for increasing atmospheric radiation absorption.

Figure 7:
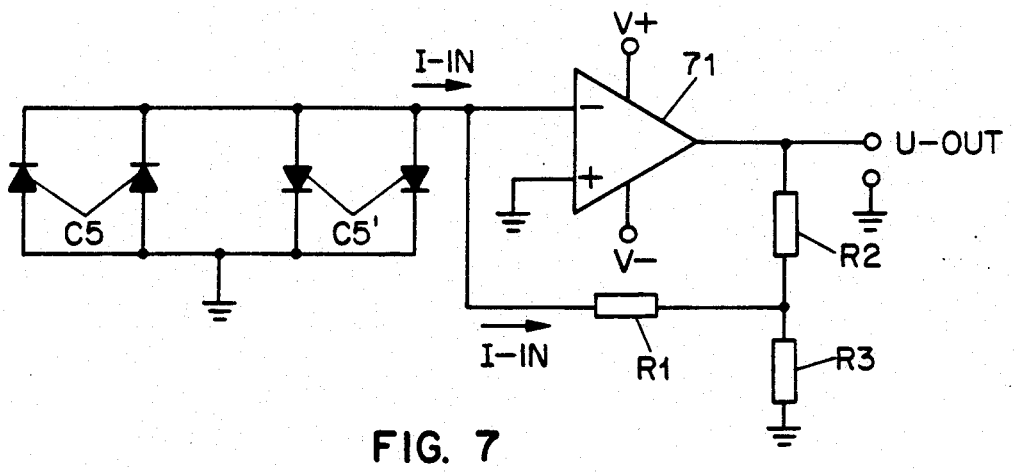
FIG. 7 is an interconnection circuit diagram for optical detectors included in the assembly of FIG. 5.

Further features serve for the exclusion of direct or indirect solar radiation which, typically, is quite intense in areas subject to forest-fire danger, and which at times exceeds $10^5$ lux. Solar radiation in the range of infrared radiation used for fire detection, i.e., with wavelengths between 3 and 5 micrometers, can reach levels triggering an alarm even in the absence of fire. Accordingly, the prevention of false alarms due to parasitic solar radiation is called for. For this purpose, a row C of light-sensitive solar cells is provided parallel to the row S of infrared-sensitive detector elements. Preferably, the peak sensitivity of the solar cells is between 0.6 and 1 micrometer. Analogous to the infrared detector elements, the solar cells are also paired as C1, C1'; . . . ; C8, C8' in differential connection. For example, as shown in FIG. 7 for the light detectors in group Z5, two photodiodes C5 and two photodiodes C5' are connected in parallel, the photodiodes C5 having anodes at ground, the photodiodes C5' having cathodes at ground, and connections being provided to a resistor R1 and to the input terminal (−) of an operational amplifier 71 which is supplied with operating voltages V+ and V−. With additional resistors R2 and R3 connected as shown, the circuit is adapted to produce an output voltage U-out corresponding to a photocurrent I-in. Specific components may be chosen as follows, for example: Siemens photodiodes SFH 983-F260C, Texas Instruments operational amplifier TL064C, R1=12.7 kilo-ohm, R2=100 kilo-ohm, R3=33 kilo-ohm.

Figure 8:
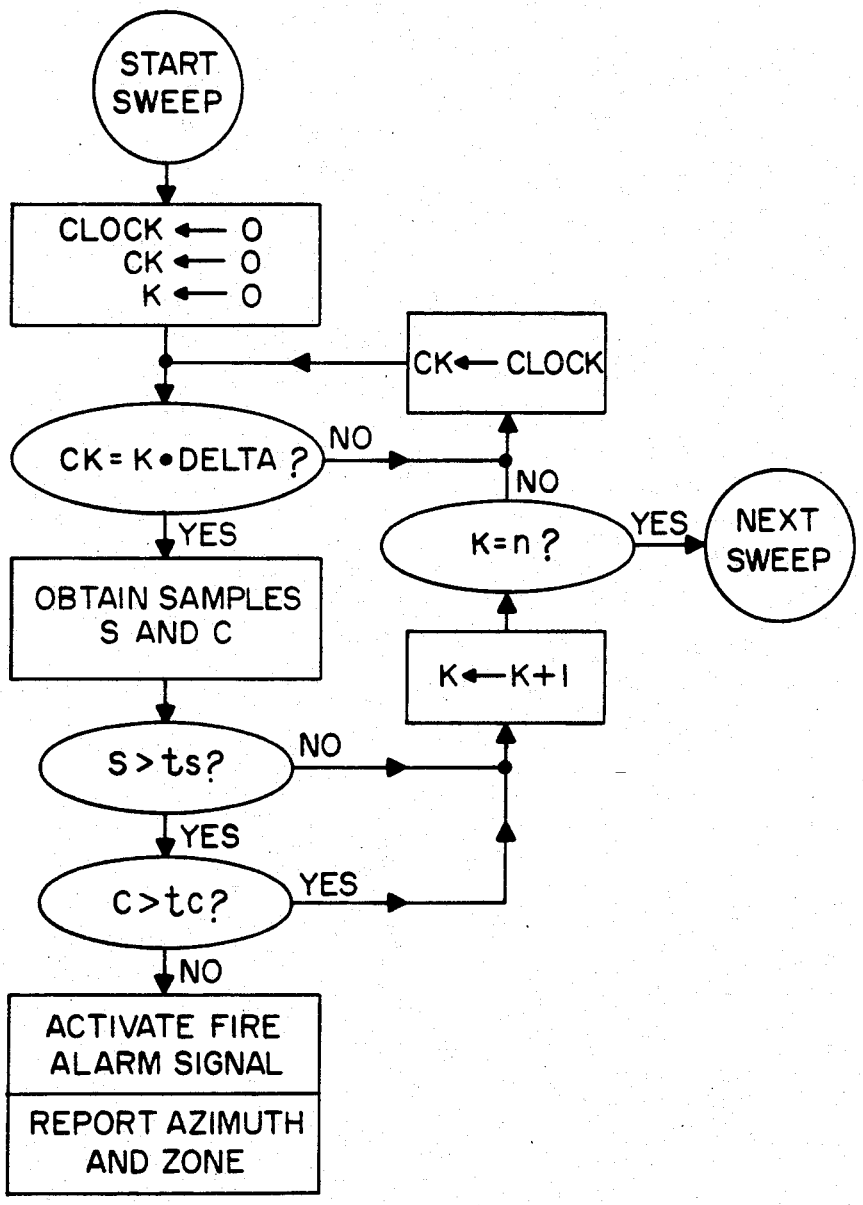
FIG. 8 is a flow chart for an exemplary signal processor using signals from infrared and optical detector circuits.

The pairs of solar cells C are connected with corresponding groups of infrared detector elements S in inhibition circuits for blocking an alarm signal when sufficiently strong parasitic radiation is detected from the corresponding detection region (i.e., when the intensity of parasitic radiation exceeds a predetermined threshold). An inhibition circuit may be realized by software for execution by a microprocessor with memory, included with fire detector apparatus. Such software may be as schematically represented by FIG. 8, where the following features are included: a resettable clock; an infrared-signal alarm threshold value, ts; a light-signal threshold value, tc; a sampling time interval, delta; and the number of samples to be taken per sweep, n. Actual sample amplitude values s and c are as obtained, respectively, from the infrared-detector circuit of FIG. 6B and the light-detector circuit of FIG. 7. A half-minute sweep (through 360°, for example) may involve taking $n=2^{12}=4096$ samples s and c, with delta=7.32 msec.

This feature provides for protection against unnecessary expense for fire-fighting measures due to false alarms. Even greater protection is provided when a controllable TV camera is installed at the location of observation, which, when a fire alarm signal is produced by the fire detector apparatus, is automatically aimed at the localized fire site for visual verification.

The invention described above for the detection of forest fires is further applicable for monitoring other extended areas or lots for sources of infrared radiation. Examples are the monitoring of fuel depot areas and of automobile parking lots.

We claim:

1. Fire detector apparatus for fire detection in an extended area (B), comprising:

a scanning device (1) having azimuthal freedom of movement for scanning the extended area (B) to detect infrared radiation emitted by a fire in the extended area (B);

a plurality of infrared detector elements (S) disposed in the scanning device (1) such that infrared radiation from a plurality of detection areas (R1, R2, . . . , R8) of the extended area (B) are detected by different respective detector elements, the detection areas (R1, R2, . . . , R8) having different angles of elevation (b1, b2, . . . , b8) as viewed from the scanning device;

focusing means (6) disposed in the scanning device (1) for focusing thermal radiation from the detection areas (R1, R2, . . . , R8) onto respective detector elements;

wherein, for enhancing the reliability of an alarm signal produced by the apparatus, detector elements (S, S') are disposed horizontally side-by-side as pairs and interconnected in a differential circuit such that radiation detected first by one element (S) and then by the other element (S') of a pair results in an output signal from the differential circuit, and such that radiation detected simultaneously by the two detector elements (S, S') does not result in an output signal from the differential circuit to signal evaluation means (FET) connected to the differential circuit.

2. Apparatus of claim 1, wherein pairs of detector elements (S, S') are disposed vertically adjacent to each other and at least approximately in the focal plane of the focusing means (6).

3. Apparatus of claim 2, wherein the detector elements (S, S') are disposed on a common support (7) which extends in an upward direction from a point on or near the optical axis (A) of the focusing means (6).

4. Apparatus of claim 3, wherein the vertical extent, area, and/or number of detector elements (S) associated with a detection area (R1, R2, . . . , R8) is directly related to the distance between the detector element (S) and the optical axis (A).

5. Apparatus of claim 4, wherein the vertical extent, area, and/or number of detector elements (S) associated with a detection area (R1, R2, . . . , R8) is chosen such that the widths (R) of the detection areas (R1, R2, . . . , R8) are at least approximately equal.

6. Apparatus of claim 5, wherein a first detector pair (S1, S1') having a lesser distance from the optical axis (A) is connected in a first circuit which produces a stronger output signal than a second circuit for a second detector pair (S2, S2') having a greater distance form the optical axis (A).

7. Apparatus of claim 6, wherein the detection circuits are adapted such that the sensitivity of infrared detection by the second detector pair (S2, S2') is at least approximately equal to the sensitivity of infrared detection by the first detector pair (S1, S1').

8. Apparatus of claim 7, further comprising an optical bandpass filter having a passband from 3 to 5 micrometers and disposed such that radiation is filtered prior to incidence on a detector element (S, S').

9. Apparatus of claim 1, further comprising:

a plurality of optical detectors (C) for detecting visible light, disposed in correspondence with infrared detector elements (S, S');

circuit means connected to the optical detectors for blocking an alarm signal when visible light is sensed having an intensity which is at least equal to a predetermined threshold intensity.

10. Apparatus of claim 9, wherein an optical detector (C) and a corresponding infrared detector element (S) are disposed on a common support (7).

11. Apparatus of claim 9, wherein an optical detector (C) has peak sensitivity in the range from 0.6 to 1 micrometer.

12. Fire detector apparatus for fire detection in an extended area (B), comprising:

a scanning device (1) having azimuthal freedom of movement for scanning the extended area (B) to detect infrared radiation emitted by a fire in the extended area (B);

a plurality of infrared detector elements (S) disposed in the scanning device (1) such that infrared radiation from a plurality of detection areas (R1, R2, . . . , R8) of the extended area (B) are detected by different respective detector elements, the detection areas (R1, R2, . . . , R8) having different angles of elevation (b1, b2, . . . , b8) as viewed from the scanning device; 14 focusing means (6) disposed in the scanning device (1) for focusing thermal radiation from the detection areas (R1, R2, . . . , R8) onto respective detector elements;

a plurality of optical detectors (C) for detecting visible light, disposed in correspondence with infrared detector elements (S);

circuit means connected to the optical detectors for blocking an alarm signal when light is sensed having an intensity which is at least equal to a predetermined threshold intensity.

13. Apparatus of claim 12, further comprising an optical bandpass filter having a passband from 3 to 5 micrometers and disposed such that radiation is filtered prior to incidence on an infrared detector element (S).

14. Apparatus of claim 12, wherein an optical detector (C) has peak sensitivity in the range from 0.6 to 1 micrometer.

* * * * *

UNITED STATES PATENT AND TRADEMARK OFFICE

CERTIFICATE OF CORRECTION

PATENT NO. : 5,218,345

DATED : June 8, 1993

INVENTOR(S) : K. Muller et al.

It is certified that error appears in the above-identified patent and that said Letters Patent is hereby corrected as shown below:

Col. 6, line 60, "14 focusing means" should read --focusing means-- and should begin a new paragraph.

Signed and Sealed this

Fifth Day of April, 1994

Bruce Lehman

BRUCE LEHMAN

*Commissioner of Patents and Trademarks*

*Attest:*

*Attesting Officer*